US007040972B2

(12) United States Patent
Hoffmann et al.

(10) Patent No.: US 7,040,972 B2
(45) Date of Patent: May 9, 2006

(54) POWER TOOL

(75) Inventors: Erhard Hoffmann, Bettlach (CH); Frank Fuchs, Rutesheim (DE)

(73) Assignee: Robert Bosch GmbH, STuttgart (DE)

( * ) Notice: Subject to any disclaimer, the term of this patent is extended or adjusted under 35 U.S.C. 154(b) by 0 days.

(21) Appl. No.: 11/037,326

(22) Filed: Jan. 18, 2005

(65) Prior Publication Data

US 2005/0221739 A1 Oct. 6, 2005

(30) Foreign Application Priority Data

Mar. 30, 2004 (DE) ..... 10 2004 016 171

(51) Int. Cl.
*B24B 7/18* (2006.01)

(52) U.S. Cl. ..... 451/357; 451/344; 451/442; 451/354; 451/456

(58) Field of Classification Search ..... 451/344, 451/442, 451–457, 354–360; 384/624
See application file for complete search history.

(56) References Cited

U.S. PATENT DOCUMENTS

| | | | | |
|---|---|---|---|---|
| 2,980,994 | A | | 4/1961 | Stachon |
| 3,722,147 | A | | 3/1973 | Brenner |
| 3,932,055 | A | | 1/1976 | Flatland |
| 4,062,152 | A | * | 12/1977 | Mehrer ..... 451/344 |
| 4,184,291 | A | * | 1/1980 | Marton ..... 451/344 |
| 4,281,457 | A | | 8/1981 | Walton, II |
| 4,930,264 | A | * | 6/1990 | Huang ..... 451/359 |
| D326,398 | S | * | 5/1992 | Fushiya et al. ..... D8/62 |
| 5,283,988 | A | * | 2/1994 | Brown ..... 451/524 |
| D351,976 | S | * | 11/1994 | Morey et al. ..... D8/62 |
| 5,609,516 | A | * | 3/1997 | Courson et al. ..... 451/456 |
| 5,993,305 | A | * | 11/1999 | Chu ..... 451/357 |
| 6,129,618 | A | * | 10/2000 | Frech ..... 451/357 |
| 6,203,415 | B1 | * | 3/2001 | Torrance-Castanza et al. ..... 451/359 |
| D442,839 | S | * | 5/2001 | Cieri et al. ..... D8/62 |
| 6,347,985 | B1 | | 2/2002 | Loveless |
| 6,413,157 | B1 | * | 7/2002 | Marton ..... 451/357 |
| 6,485,360 | B1 | * | 11/2002 | Hutchins ..... 451/357 |
| 6,503,133 | B1 | * | 1/2003 | Wuensch ..... 451/357 |

* cited by examiner

*Primary Examiner*—Lee D. Wilson
*Assistant Examiner*—Anthony Ojini
(74) *Attorney, Agent, or Firm*—Michael J. Striker

(57) ABSTRACT

A power tool with a housing (12) and a tool (18, 22) located thereon such that it is capable of being driven in a rotating and/or oscillating manner, the tool being operable as directed using vacuum flow, in particular using a vacuum cleaner. The power tool is made particularly powerful by the fact that a radial turbine wheel (34) with forward-guiding and rearward-guiding vane rows (44, 48) functions as the drive.

7 Claims, 4 Drawing Sheets

POWER TOOL

BACKGROUND OF THE INVENTION

The present invention relates to a power tool according to the definition of the species in Claim 1.

A power tool is known from U.S. Pat. No. 6,347,985 B 1, which is driven solely via the vacuum flow of a vacuum cleaner. The main feature of the known power tool is a customary Pelton turbine which uses the vacuum of the vacuum cleaner to rotate the driven spindle and, therefore, to drive the tool.

The efficiency of the known power tools with axial and Pelton turbines cannot fully meet the high demands for work output and suction performance of these power tools which are capable of being operated with commercially available vacuum cleaners.

SUMMARY OF THE INVENTION

The present invention having the features of Claim 1 has the advantage that the power tool—which is operated without its own electric motor and using only the vacuum from a vacuum cleaner, and which is designed as a sanding machine—has a level of efficiency for its applications that is so high that it enables nearly completely dust-free sanding and removal of all dust particles that form during sanding, thereby combining a high degree of abrasive wear with a highly effective suctioning-off of the sanding dust.

Due to the fact that a Pelton turbine provided with a forward-guiding vane row functions as an alternative drive of the power tool, a particularly low-profile drive with improved performance is realized.

Due to the fact that forward-guiding and rearward-guiding vane rows are integrated in the housing structure of the power tool, their manufacturing costs are particularly low.

Due to the fact that the rearward-guiding vane row has curved air guide bodies, the vacuum can be transported away with low flow resistance, which increases the efficiency of the turbine.

Due to the fact that the rearward-guiding vane row functions as a holder for the upper bearing of the turbine wheel, the function of second components is combined in one single component.

Due to the fact that the drive is composed only of lightweight plastic parts, the power tool is particularly lightweight and handy.

Due to the fact that the suction air flow for the drive is separated from the air flow for suctioning away the sanding dust, the radial turbine or Pelton turbine with forward-guiding vane row has a particularly long service life, because the sanding dust does not reach its moving parts, and they are not impaired by the abrasive effect of the sanding dust.

Due to the fact that the drive air is suctioned out of side slits located on the top of the housing, far removed from the formation of sanding dust, the amount of sanding dust reaching the turbine wheel and the moving parts and/or their bearings is kept to an absolute minimum.

Due to the fact that the vacuum entering the housing is guided such that it flows into the center of the Pelton turbine wheel with forward-guiding vane row and then flows continuously radially outwardly toward the outer edge of the turbine wheel and, from there, is suctioned away, the efficiency of the Pelton turbine is improved further.

Due to the fact that the power tool is provided with a wireless switch, with which the vacuum cleaner is capable of being switched on and off, convenient and simple operation of the power tool and/or the vacuum cleaner is possible.

Due to the fact that the rotational speed of the power tool is regulated by a variably adjustable air flap, the rotational speed of the machine is adaptable to the particular working conditions in a simple and economical manner using simple means.

Due to the fact that the housing of the power tool is composed of tubular parts capable of being connected with each other using flanges, it is particularly dimensionally stable and robust and has a low own weight.

BRIEF DESCRIPTION OF THE DRAWINGS

The present invention is explained in greater detail hereinbelow with reference to an exemplary embodiment with associated drawing.

DESCRIPTION OF THE PREFERRED EMBODIMENTS

Figure 1:
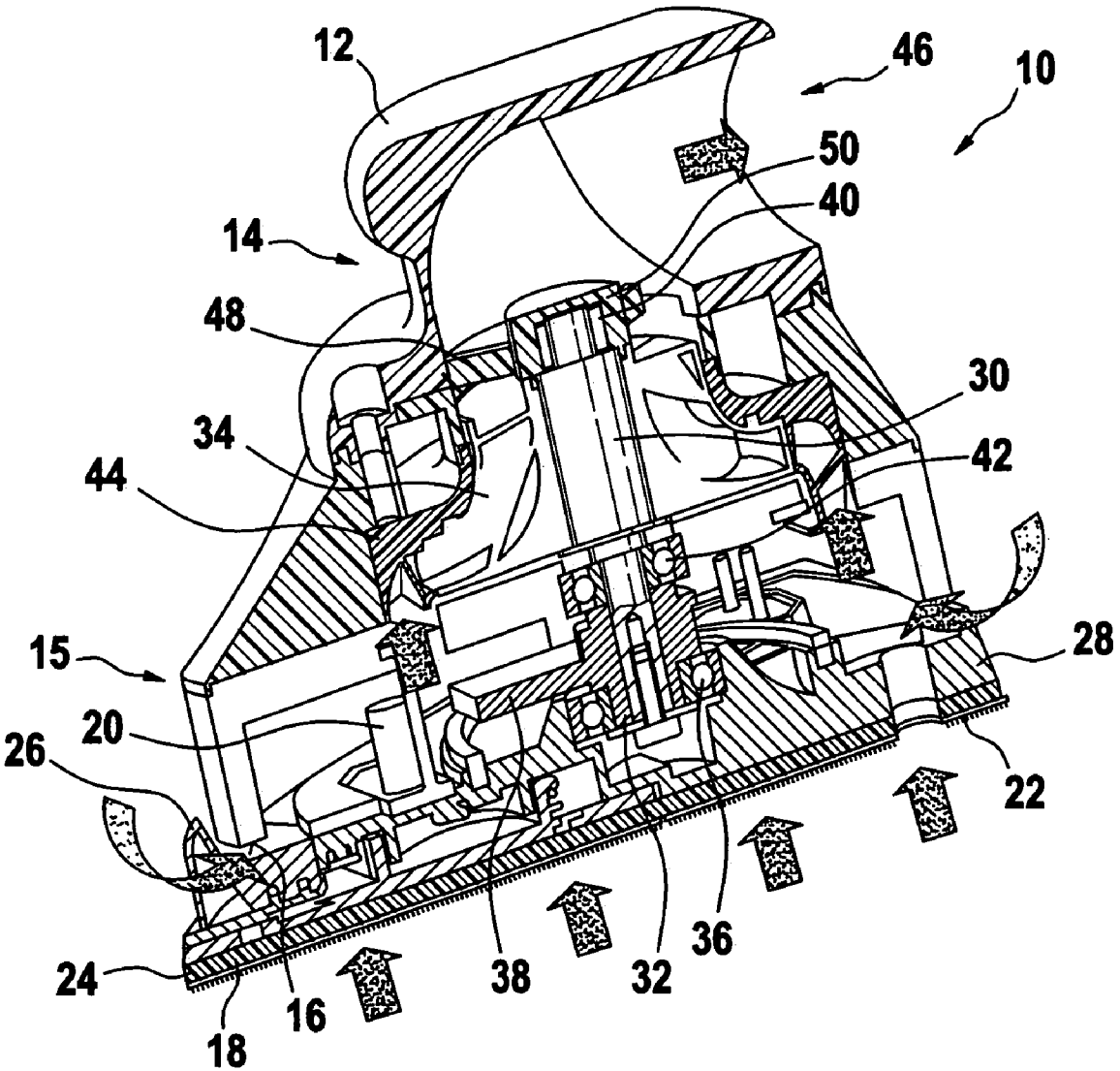
FIG. 1 shows a longitudinal sectional view of an oscillating sander

FIG. 1 shows a power tool 10 designed as an oscillating sander. It is composed of a housing 12 which is configured as a handle in its upper region, the handle continuing downward in a waist-like constriction 14 capable of being encompassed by the operator's fingers, and then widens to form a bell-shaped region 15.

Housing 12 terminates at the bottom at a flat lower edge 16 which, in its vertical projection downward, forms a triangle with outwardly arched sides. A sanding disk 18 is positioned parallel with lower edge 16, which is elastically joined with housing 12 via elastic oscillating bodies 20.

Sanding disk 18 extends with its iron-shaped surface outwardly past the triangular, vertically downwardly projecting contour of lower edge 16 and has retaining means on its underside for accommodating a sanding pad 22.

Sanding disk 18 includes a button 26 on its front, center tip 24. When said button is swiveled to the side, sanding disk 18 can be removed from housing 12 and/or a sanding disk carrier 28. Sanding disk 18 and/or sanding disk carrier 28 is capable of being driven in an orbital manner by a drive shaft 30 and an eccentric 32 mounted on its end in a torsion-proof manner, so that every point of the sanding disk and, therefore, every single abrasive grain of sanding disk 22 makes small circles with the radius of the eccentricity of eccentric 32, i.e., the typical grinding pattern of an orbital sander.

Drive shaft 30 is driven in a rotary manner by a radial turbine wheel 34. It is rotatably supported in housing 12 using an upper and lower rolling bearing 40, 42. Drive shaft 30, with its eccentric 32 mounted on the lower end, engages in a third rolling bearing 36, which itself is seated in a torsion-proof manner with its outer ring in sanding disk carrier 28 or sanding disk 18. Eccentric 32 is integrally joined with a mass-balance weight 38, which compensates for unbalance and keeps oscillations of eccentrically moving sanding disk 18 a certain distance away from housing 12.

Drive shaft 30 is encompassed in the center in a torsion-proof manner by radial turbine wheel 34 and must follow its rotation. Radial turbine wheel 34 has a bell-shaped outer contour which is tightly, i.e., with a small gap, encompassed by a stationary forward-guiding vane row 44, which steadies and/or removes turbulence form the incoming suction air which drives radial turbine wheel 34 and therefore considerably improves the input-side efficiency of the radial turbine.

The remaining parts of housing 12 also encompass radial turbine wheel 34 with a narrow gap, which transitions at the top, on the axial end of radial turbine wheel 34, into a suction duct 46 which is U-bent toward the right. At its beginning, the upper end of radial turbine wheel 34 bears—together with drive shaft 30—axially against a rearward-guiding vane row 48, which functions as bearing seat for upper rolling bearing 40 of drive shaft 30. To this end, rearward-guiding vane row 48 is configured in the shape of a star and/or a wagon wheel, whereby its hub-like center part 50 accommodates rolling bearing 40 of drive shaft 30, and air guide bodies 52 which extend radially outwardly therefrom and are configured in the manner of spokes and/or blades connect center part 50 with an outer, rim-like supporting ring 54. Spaces 58 are located between air guide bodies 52 (FIG. 5) to allow passage by the drive air which has passed the turbine wheel and is produced by an external vacuum cleaner.

Air guide bodies 52 of the rearward-guiding vane row 48 steady the outgoing air exiting radial turbine wheel 34 axially, perpendicularly upward, so that it then flows—with essentially no flow losses and with minimal turbulence—through knee-shaped suction duct 46 configured with a large radius of curvature to enhance flow, directed nearly 90° horizontally, and enters a vacuum cleaner tube (not shown) capable of being connected to suction duct 46, thereby ensuring that radial turbine wheel 34 is driven continuously.

To operate power tool 10, outside air flows between the top side of sanding disk carrier 28 and lower housing edge 16 through to radial turbine wheel 34 before it mixes with the dust extraction air, which is suctioned away—by the vacuum at suction duct 46—under sanding disk 28 and through it, in particular through dust holes 56, and which flows around radial turbine wheel 34.

The contact between radial turbine wheel 34, forward-guiding and rearward-guiding vane rows 44, 48 and abrasive, dust-containing air can result in a abraded material and dust collecting effect there, which can impair the performance and service life of the drive. To counteract this, the surfaces contacted by suction air are structured, in particular using small, regular recesses, such that they have low flow resistance and high surface rigidity.

Figure 2:
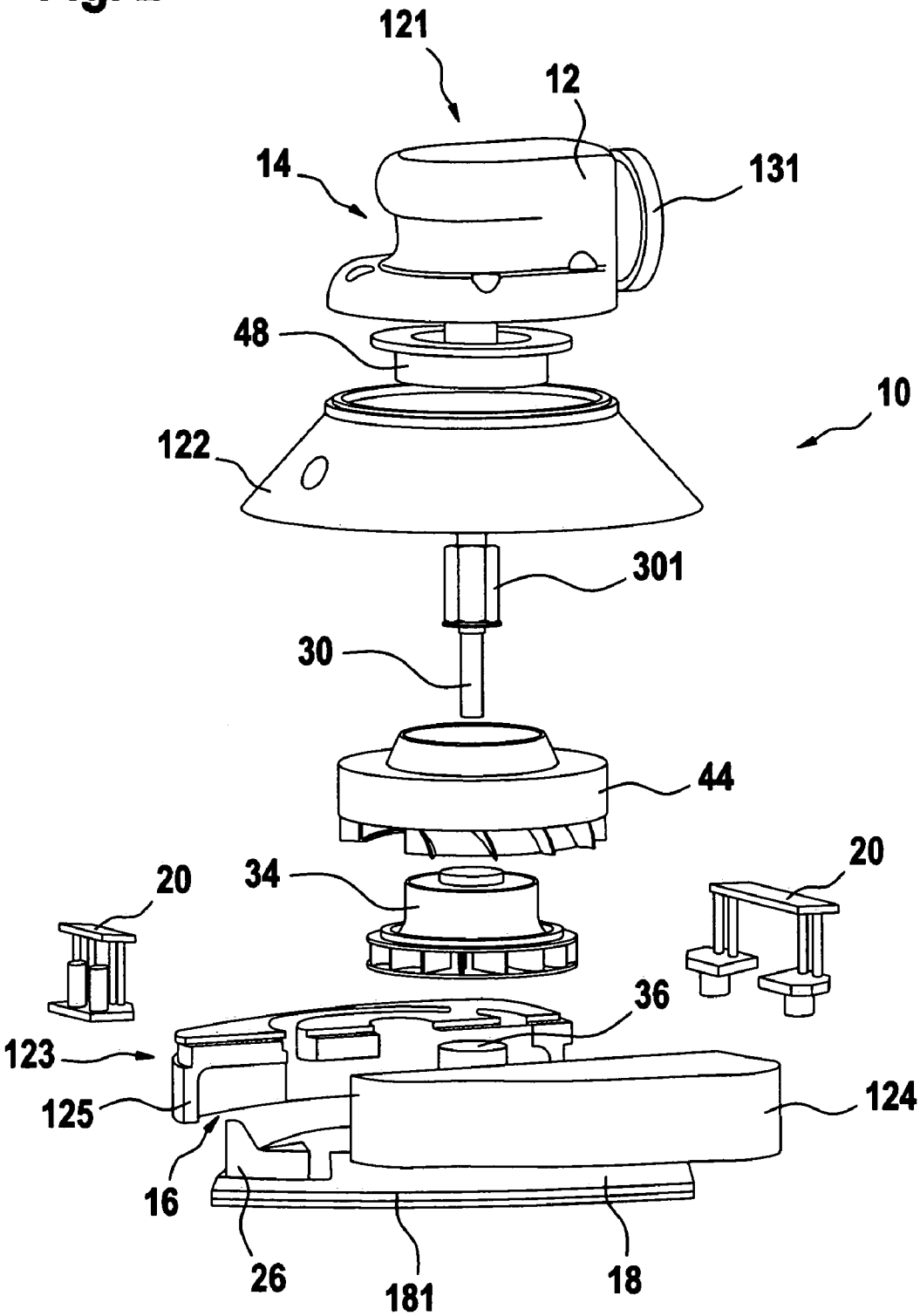
FIG. 2 shows an exploded drawing of the oscillating sander

FIG. 2 shows an exploded drawing of power tool 10 according to FIG. 1. The following details are clearly shown therein in comparison with the assembled depiction according to FIG. 1:

The upper region of housing 12 functions as handle and, with integrally molded, waist-like constriction 14, forms a separate housing part 121 which is capable of being connected with a bell-shaped housing part 122 at the bottom in a perpendicular flange connection. Rearward-guiding vane row 48 is located between housing parts 121, 122—and is overlapped radially by them—in perpendicular flange connection, and is capable of being mounted on upper housing part 121.

Drive shaft 30 connects with bell-shaped housing part 122 at the bottom as shown in the drawing. Its outer contour has an external hexagon shape 301 in a center region, or, in a further possible variant, it is knurled, or it is smooth in design, and it enables positive engagement of radial turbine wheel 34 which follows axially below forward-guiding vane row 44, the radial turbine wheel being fastened in an adhesive manner to drive shaft 30 using an injection-molding procedure, for example.

Forward-guiding vane row 44 concentrically encompasses drive shaft 30 and radial turbine wheel 34 and is provided for torsion-proof insertion in bell-shaped housing part 122. There, it directs the fresh air, which flows by radially from the outside, radially inward toward the center of radial turbine wheel 34, where it can perform its work with improved efficiency.

Forward-guiding vane row 44 is radially overlapped by bell-shaped housing part 122, whereby a further perpendicular flange connection exists between housing part 122 and lowest region 123 of housing 12, and whereby lowest region 123 is composed of two half shells 124, 125 capable of being connected transversely with each other. Oscillating bodies 20 are insertable in region 123 of housing 12 between half shells 124, 125 and are capable of being assembled, held in a positive manner, without any further aids, so that they are supported appropriately for operation of power tool 10.

As shown at the bottom, oscillating bodies 20 are capable of being screwed or clipped together perpendicularly with sanding disk 18 or sanding disk carrier 28, so that the connection between housing 12 and sanding disk 18 is created at this point. On its front tip, sanding disk carrier 28 carries the laterally displaceable button 26; when said button is in the middle position, sanding disk 18 located underneath it is lockable in place and secured against coming loose. When displaced laterally, button 281 releases sanding disk 10 located underneath it.

The region of sanding disk 18 furthest toward the front is configured as triangular sanding disk 181 to which a customary, matching triangular sanding pad is attached, the sanding pad being designed with outwardly curved sides, on which the rear region of sanding disk carrier 28 abuts, as shown on the right, the underside of which said sanding disk carrier aligns with the underside of triangular sanding disk 181. Together with the sole of the rear region of sanding disk carrier 28, the entire underside of sanding disk 18 has a contour designed in the shape of the surface of an iron, which is suitable for machining relatively large areas which were too large for an older model of a triangular sander.

In addition, due to the fact that the front region of sanding disk 18 having the shape of a separate triangular sanding disk 181 with a tip pointing forward is replaceable and/or easily rotated and, therefore, a less-worn triangle tip of the sanding pad can be moved to the front, and/or if the triangular sanding pad becomes worn, it can be replaced easily, together with triangular sanding disk 181 in particular.

Inside housing parts 121, 122, rearward-guiding vane row 48 bears downwardly on forward-guiding vane row 44, secured axially against coming loose, and without play, thereby simultaneously improving air ducting.

As shown on the right, housing part 121 is provided with an adapter 131 detachably inserted in suction duct 46, the adapter functioning as an airtight connection—secured against accidentally coming loose—of a vacuum cleaner hose, which is not shown.

Figure 3:
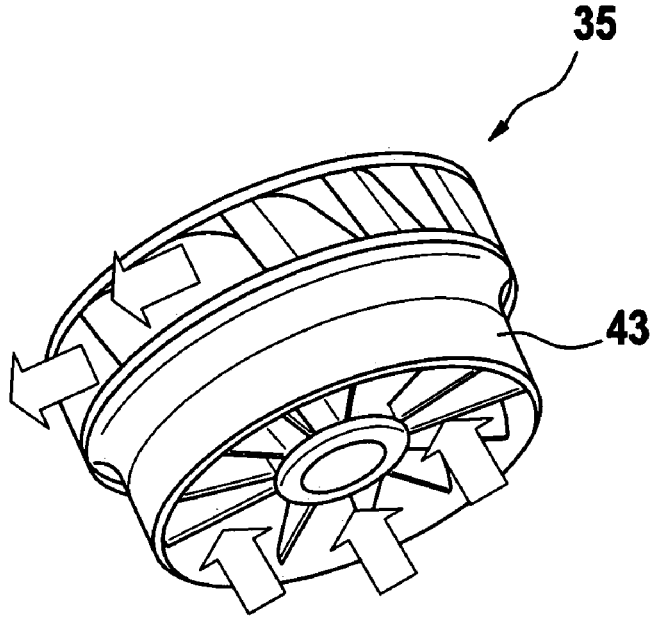
FIG. 3 shows a Pelton turbine wheel with forward-guiding vane row

FIG. 3 shows a Pelton turbine wheel 35, which is combined with a forward-guiding vane row 43 connected at the bottom and positioned in torsion-proof fashion. Air flows on Pelton turbine wheel 35 continually axially or from the bottom in the center through forward-guiding vane row 43, whereby this air—which is steadied by forward-guiding vane row 43—reaches Pelton turbine wheel 35 tangentially with a high degree of efficiency. In Pelton turbine wheel 35, the inflowing air is directed radially from the inside to the outside, where it is suctioned away. In so doing, it provides the desired, improved output.

Figure 4:
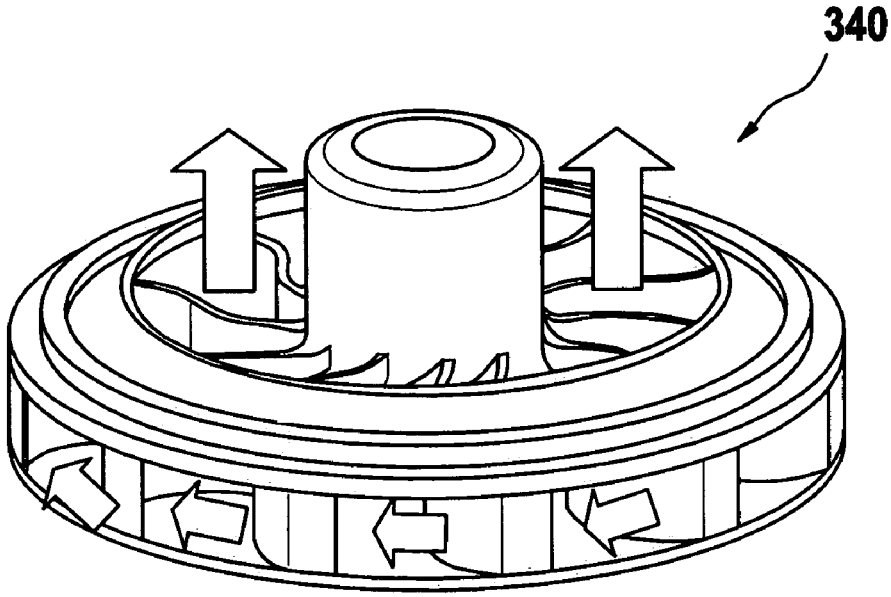
FIG. 4 shows a Pelton turbine wheel alone

FIG. 4 shows a Pelton turbine wheel 340 which, in contrast to radial turbine wheel 34 according to FIG. 1, is configured considerably flatter in design, although it also provides lower output. Despite the lower efficiency, a Pelton turbine wheel can be used advantageously, in certain circumstances, for particularly small and low-profile power tools with vacuum cleaner drive. It is operated for improved efficiency such that inflowing air drawn in radially outwardly is expanded radially inwardly and redirected axially upwardly with a 90-degree change of direction. Due to the centrifugal forces used, higher output is achieved than with Pelton turbine wheels, which are operated using only air which flows against them tangentially.

Figure 5:
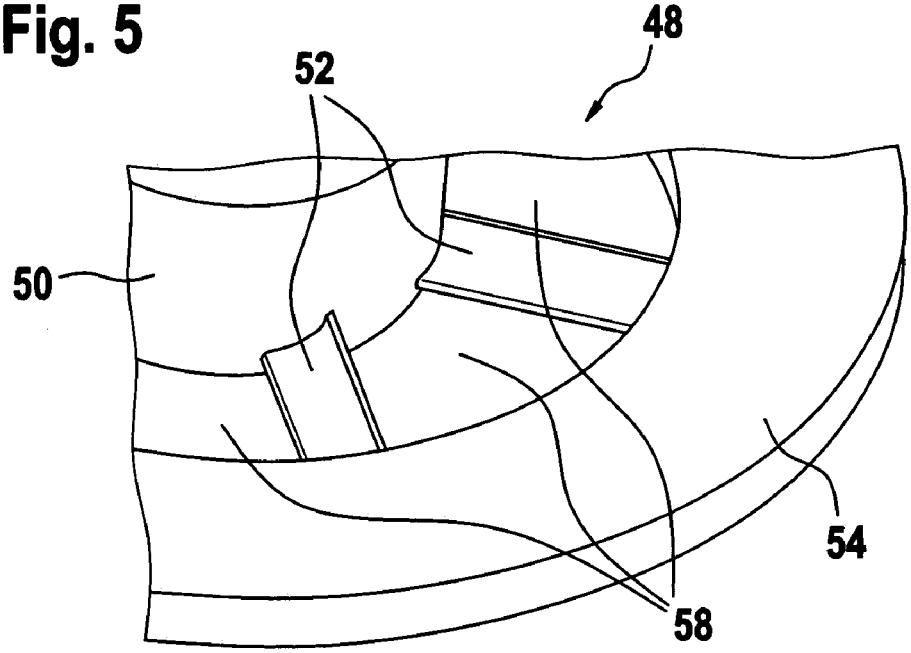
FIG. 5 shows a rearward-guiding vane row alone

FIG. 5 shows rearward-guiding vane row 48 alone. Shown are the supporting ring 54, regularly arranged, spoke-like air guide bodies 52, spaces 58 and hub-like center section 50.

Figure 6:
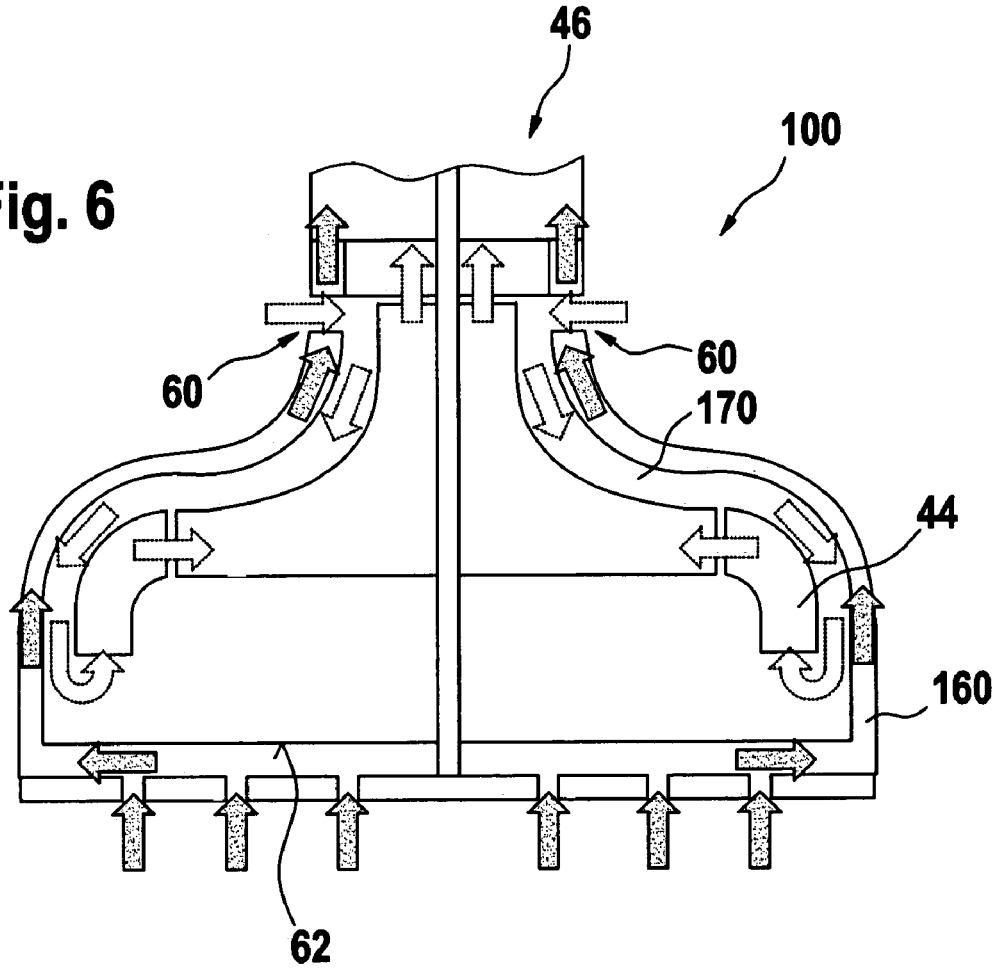
FIG. 6 shows a schematic longitudinal sectional view as a further power tool

FIG. 6 shows the schematic illustration of a power tool 100, the dust extraction air flow and drive air flow of which are separated from each other. The air filled with dust is suctioned under the tool and guided radially outwardly through dust channels 160 upwardly in the direction of suction duct 46. The drive air flow is suctioned radially from the outside to the inside through suction holes 60 in the waist-like region of constriction 14 (FIG. 1), and is guided axially downward in separate air guide ducts 170, whereby it follows the bell-shaped contour of housing 12 and, in the lower region of the housing, is redirected back upward. The dust-filled air and the dust-free air are prevented from mixing by a lower dividing wall 62. The drive air then flows into forward-guiding vane row 44 and, from there, with turbulence eliminated, it flows radially inwardly into radial turbine wheel 34. There, it is redirected upwardly and flows to suction duct 46 of power tool 100. Compared with power tool 10 shown in FIG. 1, this has the advantage that the abrasive, dust-filled air does not impair its moving and/or air-conducting parts. They have a longer service interval, and the flow conditions on its air-conducting parts remain favorable at all times.

The dust-filled air is combined with the dust-free, "used" drive air in the region of suction duct 46 and directed to the vacuum cleaner. Flow means which steady and/or remove turbulence from the air are not shown in the region where the two types of air are combined.

In an exemplary embodiment of the power tool which is similar to the previous exemplary embodiments but is not shown, its housing includes a wireless switch which communicates with a counterconnection assigned to the vacuum cleaner and which enables the vacuum cleaner and, therefore the power tool, to be switched on and off conveniently and economically. Furthermore, to enable regulation of rotational speed and power, a button located in the region gripped by the operator's hand is provided for opening and closing a throttle which can release or stop the suction air flow and/or open the bypass duct between the turbine and the vacuum cleaner tube.

The invention claimed is:

1. A power tool, comprising:

a housing (12); and a tool (18, 22) disposed on said housing in such a way that the tool is driven in a rotating and/or oscillating manner, the tool being operable using vacuum flow, wherein a radial turbine with a radial turbine wheel (34) functions as a drive, the radial turbine having means for steadying inflowing and outflowing air in the form of a forward-guiding vane row and a rearward-guiding vane row (44, 48), wherein the rearward-guiding vane row (48) includes air guide bodies (52) configured as curved blades, wherein the rearward-guiding vane row (48) functions as a bearing seat for the radial turbine wheel (34), and wherein air which drives the radial turbine wheel is directed in a center region of the radial turbine wheel and is then suctioned away radially outwardly by an outer edge of the radial turbine wheel.

2. The power tool as recited in claim 1, wherein the forward-guiding vane row (44) and the rearward-guiding vane row (48) are positioned in the housing (12) in a reinforcing manner.

3. The power tool as recited in claim 1, wherein the vacuum flow which drives the turbine wheel (34, 35) is guided separately from a dust air flow, so that air filled with dust and suctioned away from a work piece does not come in contact with parts of the power tool which move and/or conduct the drive air.

4. The power tool as recited in claim 1, wherein air which drives the turbine wheel (34, 35) enters the housing (12) through air intake ducts (60), wherein the air intake ducts are disposed remotely from the tool.

5. The power tool as recited in claim 1, wherein the power tool is a surface sanding machine in the form of an oscillating sander.

6. The power tool as recited in claim 1, wherein air which drives the turbine wheel (34, 35) enters the housing (12) through air intake ducts (60), wherein the air intake ducts are disposed far above the tool (18, 22), and wherein the tool is a material-removing tool.

7. A power tool, comprising:

a housing (12); and a tool (18, 22) disposed on the housing in such a way that the tool is driven in a rotating and/or oscillating manner, the tool being operable using vacuum flow, wherein a radial turbine with a radial turbine wheel (34) functions as a drive, the radial turbine having means for steadying inflowing and outflowing air in the form of a forward-guiding vane row and a rearward-guiding vane row (44, 48), wherein a Pelton turbine with Pelton turbine wheel (35) with forward-guiding vane row and with rearward-guiding vane row (48) functions as the drive, wherein the rearward-guiding vane row (48) includes air guide bodies (52) configured as curved blades, wherein the rearward-guiding vane row (48) functions as a bearing seat for the Pelton turbine wheel (35), and wherein air which drives the Pelton turbine wheel (35) is directed in a center region of the Pelton turbine wheel (35) and is then suctioned away radially outwardly by an outer edge of the Pelton turbine wheel (35).

* * * * *